US009215535B2

(12) United States Patent
Oesch et al.

(10) Patent No.: US 9,215,535 B2
(45) Date of Patent: Dec. 15, 2015

(54) HEARING ASSISTANCE SYSTEM AND METHOD

(75) Inventors: Yves Oesch, Neuchatel (CH); Claude Richard, Fribourg (CH); Timothee Jost, Auvernier (CH); Marc Secall, Constantine (CH); Christoph Schmid, Zimmerwald (CH); Rainer Platz, Stevenson Ranch, CA (US); Evert Dijkstra, Fontaines (CH)

(73) Assignee: Sonova AG, Stäfa (CH)

( * ) Notice: Subject to any disclaimer, the term of this patent is extended or adjusted under 35 U.S.C. 154(b) by 316 days.

(21) Appl. No.: 13/989,234

(22) PCT Filed: Nov. 24, 2010

(86) PCT No.: PCT/EP2010/068125

§ 371 (c)(1),
(2), (4) Date: Jun. 14, 2013

(87) PCT Pub. No.: WO2011/015675

PCT Pub. Date: Feb. 10, 2011

(65) Prior Publication Data

US 2013/0259237 A1 Oct. 3, 2013

(51) Int. Cl.
*H04R 25/00* (2006.01)

(52) U.S. Cl.
CPC ..... *H04R 25/552* (2013.01); *H04R 25/407* (2013.01); *H04R 25/554* (2013.01)

(58) Field of Classification Search
None
See application file for complete search history.

(56) References Cited

U.S. PATENT DOCUMENTS

| | | | | |
|---|---|---|---|---|
| 5,905,464 | A | 5/1999 | Lanciaux | |
| 6,748,324 | B2 | 6/2004 | Patwari et al. | |
| 6,778,674 | B1 * | 8/2004 | Panasik et al. | 381/313 |
| 8,019,386 | B2 | 9/2011 | Dunn et al. | |
| 8,369,551 | B2 | 2/2013 | Kornagel | |
| 2005/0191971 | A1 | 9/2005 | Boone et al. | |
| 2007/0230714 | A1 | 10/2007 | Armstrong | |

FOREIGN PATENT DOCUMENTS

| | | | |
|---|---|---|---|
| EP | 1 303 166 | A2 | 4/2003 |
| EP | 1 879 426 | A2 | 1/2008 |
| EP | 2 000 816 | A2 | 12/2008 |
| EP | 2 099 236 | A1 | 9/2009 |
| WO | 2006/104634 | A2 | 10/2006 |

(Continued)

*Primary Examiner* — Brenda Bernardi
(74) *Attorney, Agent, or Firm* — Roberts Mlotkowski Safran & Cole, PC; David S. Safran

(57) ABSTRACT

A hearing assistance system and method for wireless RF audio signal transmission from at least one audio signal source to ear level receivers, wherein a close-to-natural hearing impression is to be achieved. At least one parameter of the RF signal as received from a transmission unit at a respective receiver unit to create left ear RF signal measurement data and right ear RF signal measurement data, respectively. The angular localization of each transmission unit is obtained by comparing, for each transmission unit, the left ear RF signal measurement data and the right ear RF signal measurement data. The audio signals are processed and distributed according to the estimated angular localization of each transmission unit in a manner so that the angular localization impression of the audio signals from each transmission unit as perceived by the user corresponds to the estimated angular localization of the respective transmission unit.

21 Claims, 7 Drawing Sheets

(56) References Cited

FOREIGN PATENT DOCUMENTS

| | | | |
|---|---|---|---|
| WO | 2008/098590 | A1 | 8/2008 |
| WO | 2008/112765 | A1 | 9/2008 |
| WO | 2008/138365 | A1 | 11/2008 |
| WO | 2009/056922 | A1 | 5/2009 |
| WO | 2009/072040 | A1 | 6/2009 |
| WO | 2009/147662 | A1 | 12/2009 |
| WO | 2011/098142 | A1 | 8/2011 |

* cited by examiner

TDMA Schedule

| 0 | 1 | 2 | 3 | 4 | 5 | 6 | 7 | 8 | 9 | 10 | 11 | 12 | 13 |
|---|---|---|---|---|---|---|---|---|---|---|---|---|---|
| | | | | | | | | | | | | | |
| B | R | Mic1 | | Mic2 | | Mic3 | | audio$_R$ | | audio$_L$ | | RSSI$_R$ | RSSI$_L$ |

HEARING ASSISTANCE SYSTEM AND METHOD

BACKGROUND OF THE INVENTION

1. Field of the Invention

The invention relates to a system for providing hearing assistance to a user, comprising at least one audio signal transmission unit comprising an audio signal source, typically a microphone arrangement, and means for transmitting audio signals from the audio signal source via a wireless radio frequency link to a left ear receiver unit worn at the user's left ear and a right ear receiver unit worn at the user's right ear. Typically, each of the receiver units is connected to a hearing aid, so that the user's hearing can be stimulated according to the audio signals of the audio signal source.

2. Description of Related Art

Typically, such wireless microphones are used by teachers teaching hearing impaired persons in a classroom (wherein the audio signals captured by the wireless microphone of the teacher are transmitted to a plurality of receiver units worn by the hearing impaired persons listening to the teacher) or in cases where several persons are speaking to a hearing impaired person (for example, in a professional meeting, wherein each speaker is provided with a wireless microphone and with the receiver units of the hearing impaired person receiving audio signals from all wireless microphones). Another example is audio tour guiding, wherein the guide uses a wireless microphone.

Typically, the wireless audio link is an FM (frequency modulation) radio link operating in the 200 MHz frequency band. Examples for analog wireless FM systems, particularly suited for school applications, are described in EP 1 864 320 A1 corresponds to WO 2006/104634 A2 and WO 2008/138365 A1.

In recent systems the analog FM transmission technology is replaced by employing digital modulation techniques for audio signal transmission, most of them working on other frequency bands than the former 200 MHz band.

U.S. Pat. No. 8,019,386 B2 relates to a hearing assistance system comprise a plurality of wireless microphones worn by different speakers and a receiver unit worn at a loop around a listener's neck, with the sound being generated by a headphone connected to the receiver unit, wherein the audio signals are transmitted from the microphones to the receiver unit by using a spread spectrum digital signals. The receiver unit controls the transmission of data, and it also controls the pre-amplification gain level applied in each transmission unit by sending respective control signals via the wireless link. Mixing of the received audio signals is controlled such that the signal with the highest audio power is amplified with unity gain, and the other signals are attenuated by 6 dB.

International Patent Application Publication WO 2008/098590 A1 relates to a hearing assistance system comprising a transmission unit having at least two spaced apart microphones, wherein a separate audio signal channel is dedicated to each microphone, and wherein at least one of the two receiver units worn by the user at the two ears is able to receive both channels and to perform audio signal processing at ear level, such as acoustic beam forming, by taking into account both channels.

International Patent Application Publication WO 2011/098142 A1 relates to a hearing assistance system comprising a plurality of wireless microphones, a relay unit and a left ear receiver unit and a right ear receiver unit, wherein the relay unit as adapted to mix the audio signals of the different transmission units and to transmit the mixed audio signal in a manner that a different audio signal is received by the right ear receiver unit and by the left ear receiver unit in order to enable spatial hearing by the user of the receiver units.

European Patent Application EP 2 099 236 A1 relates to a hearing aid fitting method using simulated surround sound, wherein different head related transfer functions are applied to test audio signals supplied to the hearing aid.

U.S. Pat. No. 8,369,551 B2 relates to a hearing aid receiving audio signals via a wireless audio link, wherein the distance to the audio signal transmitter is monitored by monitoring the reception quality.

European Patent Application EP 1 303 166 A2 relates to a hearing aid which is capable of determining the angular position of a speaking person.

International Patent Application Publication WO 2009/072040 A1 relates to a right ear hearing aid and a left ear hearing aid which are capable of localizing a sound source for controlling acoustic beam forming in each of the hearing aids.

U.S. Patent Application Publication 2007/0230714 A1 relates to a binaural system comprising a right ear hearing aid and a left ear hearing aid, which are capable of exchanging audio signals via a wireless link, wherein a delayed sound signal is transmitted from one of the hearing aids to the other one in order to achieve a time delay between the sound provided by the right hearing aid and the sound provided by the left ear hearing aid; this delay mimics how the ears would naturally hear a sound coming from one side from the head.

International Patent Application Publication WO 2009/056922 A1 relates to a telephone system, wherein the voices of different participants of a telephone conference are supplied as a mixed stereo signal to two ears of a listener in order to create a spatial perception of the different voices, thereby supporting the listener in distinguishing the different persons.

Various methods are known for estimating the angular localization of a source of a radio frequency (RF) signal with regard to a RF receiver. International Patent Application Publication WO 2009/147662 A1 relates to a method for determining whether a target is within a direction sector of interest of a direction finder, wherein the direction finder comprises two antennas arranged in a broad-side configuration. U.S. Pat. No. 6,748,324 B2 relates to a method of estimating the angular localization of a wireless device by a direction of arrival (DOA) measurement. European Patent Application EP 2 000 816 A2 relates to a communication system comprising a mobile phone in a LAN, wherein the angle of arrival of a RF signal and a receiver device is estimated, wherein the transmitting device includes two directional antennas which are tilt relative to each other and with regard to the front of the transmitting device, and wherein the receiving device includes a directional antenna having directivity toward the front of the receiving device. International Patent Application Publication WO 2008/112765 A1 relates to a car finder, wherein the car is provided with a RF signal source and wherein the direction finding device is provided with a directional receiver antenna, and wherein the omni-directional field created by the RF signal transmitter is analyzed by a direction sweep of the receiver antenna, with the RSSI (received signal strength indication) being measured during the sweep.

U.S. Pat. No. 5,905,464 relates to a binaural system comprising two ear phones and an RF antenna having a single analysis axis which is parallel to a line connecting the two ears, which system is used for estimating the angular localization of a source of an RF signal representing a spatial mark and which generates an audio signal representative of the angular direction of the RF signal source; the audio signal may be distributed on to the two ear phones in such a manner that a spatial hearing impression is created which indicates the direction of the RF signal source. The system may be used, for example, by persons working in a dangerous, low-visibility zone, such as firemen.

SUMMARY OF THE INVENTION

It is an object of the invention to provide for a hearing assistance system for wireless RF audio signal transmission from at least one audio signal source to ear level receivers, wherein a close-to-natural hearing impression is to be achieved. It is a further object to provide for a corresponding hearing assistance method.

According to the invention these objects are achieved by a hearing assistance system and a hearing assistance method as described herein.

The invention is beneficial in that, by estimating the angular localization of each transmission unit by comparing, for each transmission unit, the left ear RF signal measurement data and the right ear RF signal measurement data obtained from measuring at least one parameter of the RF signal as received from each transmission unit at the respective receiver unit and by distributing the audio signals onto a left ear channel to be supplied via the left ear receiver unit to the left ear stimulating means and a right ear channel to be supplied via the right ear receiver unit to the right ear stimulating means according to the estimated angular localization of each transmission unit in a manner so that the angular localization impression of the audio signals from each transmission unit as perceived by the user corresponds to the estimated angular localization of the respective transmission unit, it is possible to mimic the natural hearing impression which would result from acoustic transmission of the audio signals from the respective audio signal source. Thereby a closed-to-natural hearing impression is created; in particular, if in case that the transmission units are formed by a plurality of wireless microphones used by different persons, the user's capability to distinguish the different voices is enhanced due to the spatial separation of the voices in the sound perceived by the user. Estimating the angular localization of the transmission unit(s) by comparing RF signal measurements at the left ear and at the right ear of the user is a particularly simple and nevertheless reliable method which avoids the need for bulky system components, such as rotating directional antennas, or the need for the electrical combination of signals of a plurality of antennas which would result in complex and power hungry circuitry, thereby enabling a relatively simply design of the system.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
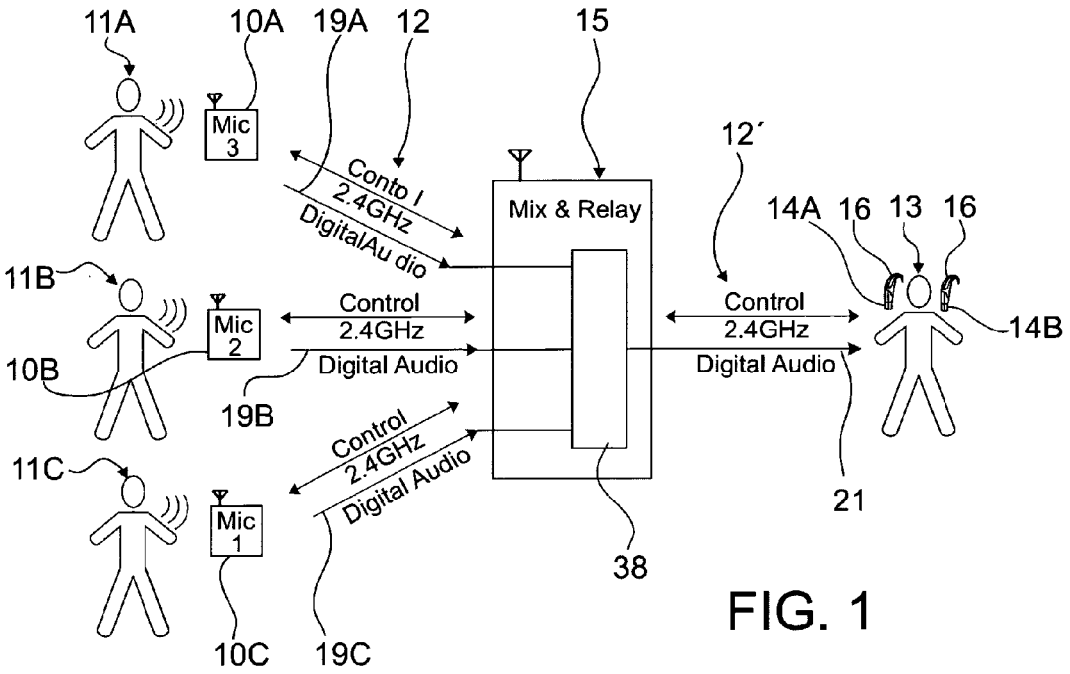
FIG. 1 is a schematic view of a first example of a hearing assistance system according to the invention.

The hearing assistance system shown in FIG. 1 comprises a plurality of transmission units 10 (which are individually labeled 10A, 10B, 10C), a relay unit 15, and two receiver units 14 (one labeled 14A connected to a right-ear hearing aid 16 and another one labeled 14B connected to a left-ear hearing aid 16) worn by a hearing-impaired listener 13.

Figure 2:
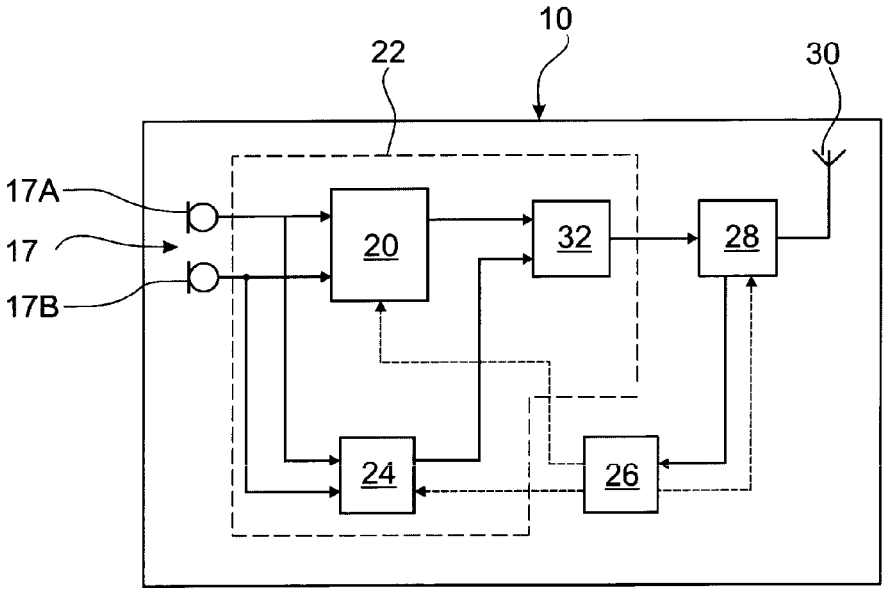
FIG. 2 is an illustration of a schematic example of the audio signal path in a transmission unit of the system of FIG. 1.

As shown in FIG. 2, each transmission unit 10 comprises a microphone arrangement 17 for capturing audio signals from the respective speaker's 11 voice, an audio signal processing unit 20 for processing the captured audio signals, a digital transmitter 28 and an antenna 30 for transmitting the processing audio signals as an audio stream 19 consisting of audio data packets to the relay unit 15 (in FIG. 1, the audio stream from the transmission unit 10A is labeled 19A, the audio stream from the transmission unit 10B is labeled 19B, etc.). The audio streams 19 form part of a digital audio link 12 established between the transmission units 10 and the relay unit 15, which link also serves to exchange control data packets between the relay unit 15 and the transmission units 10. The transmission units 10 may include additional components, such as a voice activity detector (VAD) 24. The audio signal processing unit 20 and such additional components may be implemented by a digital signal processor (DSP) indicated at 22. In addition, the transmission units 10 also may comprise a microcontroller 26 acting on the DSP 22 and the transmitter 28. The microcontroller 26 may be omitted in case that the DSP 22 is able to take over the function of the microcontroller 26. Preferably, the microphone arrangement 17 comprises at least two spaced-apart microphones 17A, 17B, the audio signals of which may be used in the audio signal processing unit 20 for acoustic beamforming in order to provide the microphone arrangement 17 with a directional characteristic.

The VAD 24 uses the audio signals from the microphone arrangement 17 as an input in order to determine the times when the person 11 using the respective transmission unit 10 is speaking. The VAD 24 may provide a corresponding control output signal to the microcontroller 26 in order to have, for example, the transmitter 28 sleep during times when no voice is detected and to wake up the transmitter 28 during times when voice activity is detected (in order to maintain synchronization with the master device—usually the relay unit 15—also during times when said speaker 11 is not speaking, the transmitter 28 of that transmission unit 10 is adapted to also wake up at least during some times when reception of beacon packets from the master device is to be expected; this will be explained in more detail below). In addition, an appropriate output signal of the VAD 24 may be transmitted via the wireless link 12. To this end, a unit 32 may be provided which serves to generate a digital signal comprising the audio signals from the processing unit 20 and the control data generated by the VAD 24, which digital signal is supplied to the transmitter 28. In addition to the VAD 24, the transmission unit 10 may comprise an ambient noise estimation unit (not shown in FIG. 2) which serves to estimate the ambient noise level and which generates a corresponding output signal which may be supplied to the unit 32 for being transmitted via the wireless link 12.

In practice, the digital transmitter 28 is designed as a transceiver, so that it cannot only transmit data from the transmission unit 10 to the relay unit 15 but also receive control data and commands sent from the relay unit 15, as will be explained in more detail below.

According to one embodiment, the transmission units 10 may be adapted to be worn by the respective speaker 11 below the speaker's neck, for example as a lapel microphone or as a shirt collar microphone.

Figure 4:
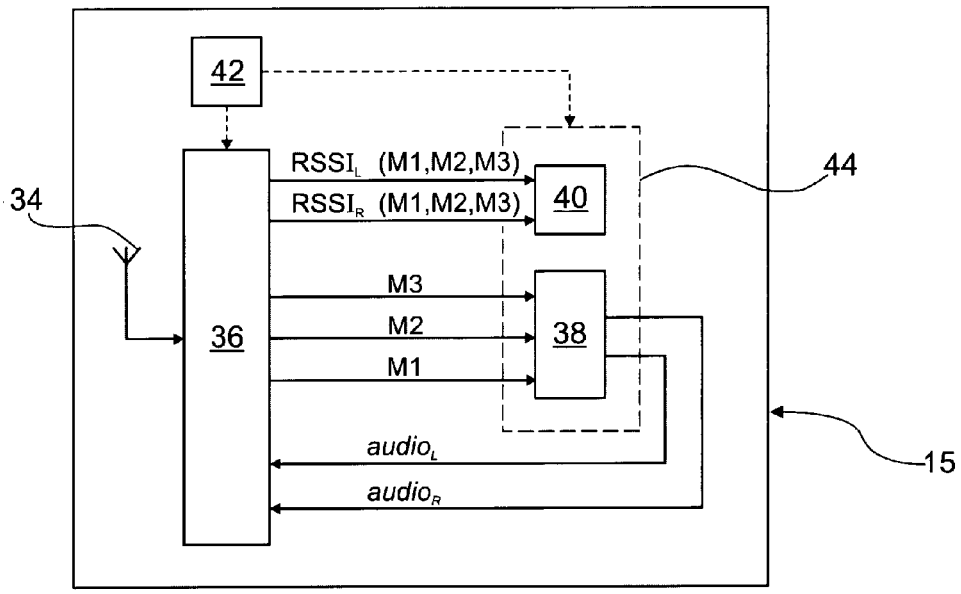
FIG. 4 is an illustration of an example of the audio signal path in a relay unit of the system of FIG. 1.

The relay unit 15, according to the example shown in FIG. 4, comprises an antenna 34, a digital transceiver 36, an audio signal processing unit 38, an angular localization estimation unit 40 and a microcontroller 42. The audio signal processing unit 38 and the angular localization estimation unit 40 may be implemented by a DSP 44. The microcontroller 42 acts to control the digital transceiver 36 and the DSP 44. The audio signal streams 19A, 19B, 19C transmitted from the transmission units 10A, 10B, 10C via the link 12 are received via the antenna 34 by the transceiver 36 and are demodulated into respective output signals M1, M2, M3 which are supplied as separate signals, i.e., as three audio streams, to the audio signal processing unit 38.

The relay unit 15 also receives, via the link 12', for each of the transmission units 10A, 10B, 10C left ear RF signal measurement data from the left ear receiver unit 14B and right ear RF signal measurement data from the right ear receiver unit 14A, which data is demodulated by the transceiver 36 and is supplied as input to the angular localization estimation unit 40 which serves to estimate, from such data, the angular localization of each of the transmission units 10A, 10B, 10C relative to the receiver units MA, 14B and to control the audio signal processing unit 38 according to the estimated angular localization of each transmission unit. As will be explained later in more detail, such measurement data preferably is an RSSI (Radio Signal Strength Indication) value for each of the transmission units 10A, 10B, 10C for the left ear receiver unit 14B (indicated by $RSSI_L$ in FIG. 4) and for the right ear receiver unit 14A (indicated by $RSSI_R$ in FIG. 4).

The audio signal processing unit 38 serves to process the received audio signals M1, M2, M3 in such a manner that a stereo signal is generated by distributing the audio signals onto a left ear channel (indicated by "$audio_L$" in FIG. 4) to be supplied to the left ear receiver unit 14B and a right ear channel (indicated by "$audio_R$" in FIG. 4) to be supplied to the right ear receiver unit 14A in such a manner that the angular localization impression of the audio signals from each transmission unit 14A, 14B, 14C as received by the user of the receiver unit 14A, 14B corresponds to the estimated angular localization of the respective transmission unit 14A, 14B, 14C. This stereo signal is supplied to the transceiver 36 for being transmitted as audio stream 21 via the link 12' to the receiver unit 14A, 14B.

For example, the angular localization impression may be created by introducing a relative phase delay between the left ear channel signal part and the right ear channel signal part of the audio signals from the respective transmission unit 14A, 14B, 14C according to the estimated angular localization of the respective transmission unit. Alternatively or in addition, the angular localization impression may be created by introducing a relative level difference between the left ear channel signal part and the right ear channel signal part of the audio signals from the respective transmission 14A, 14B, 14C according to the estimated angular localization of the respective transmission unit.

Figure 3:
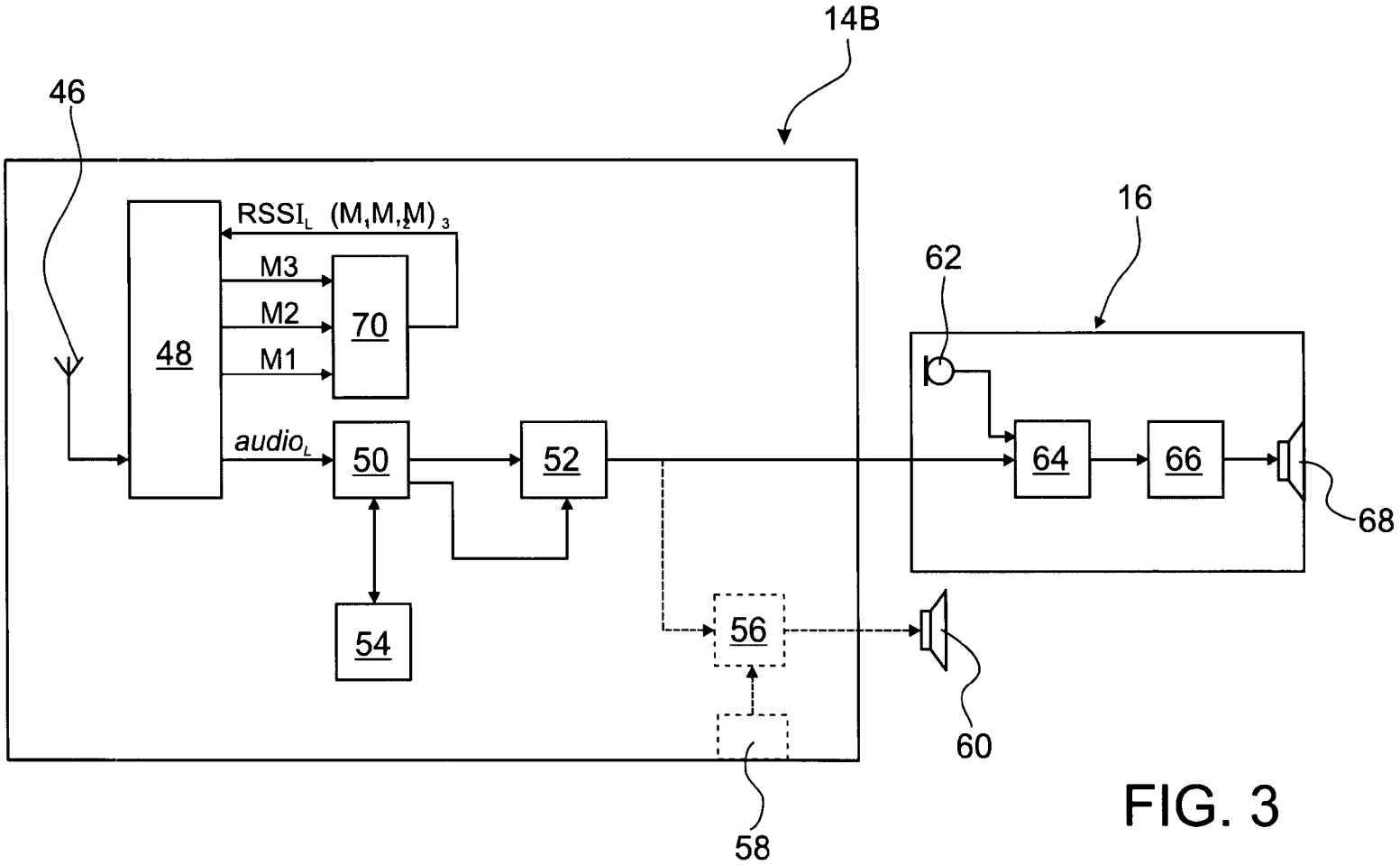
FIG. 3 is an illustration of a schematic example of the audio signal path of a receiver unit of the system of FIG. 1.

An example of the audio signal paths in the left ear receiver unit 14B is shown in FIG. 3. The receiver unit 14B comprises an antenna 46, a digital transceiver 48, a DSP 50 acting as a processing unit which separates the received signals into the audio signals and the control data and which is provided for advanced processing, e.g., equalization of the audio signals according to the information provided by the control data, and a memory 54 for the DSP 50. The processed left ear channel audio signals $audio_L$, as received from the relay unit 15 are supplied, after digital to analog conversion, to an amplifier 52 which may be a variable amplifier serving to amplify the audio signals by applying a gain controlled by the control data received via the digital link 12'. The amplified audio signals are supplied to a hearing aid 16 including a microphone 62, an audio signal processing unit 64, and amplifier and an output transducer (typically a loudspeaker 68) for stimulating the user's hearing. Alternatively, the variable gain amplifier may be realized in the digital domain by using a PWM (pulse width modulation) modulator taking over the role of the D/A-converter and the power amplifier. Rather than supplying the audio signals via an analog link from the receiver unit 14B to the hearing aid 16, they may be supplied as digital signals via a digital interface to the hearing aid 16.

Rather than supplying the audio signals amplified by the amplifier 52 to the input of a hearing aid 16, the receiver unit 14 may include an audio power amplifier 56 which may be controlled by a manual volume control 58 and which supplies power amplified audio signals to a loudspeaker 60 which may be an ear-worn element integrated within or connected to the receiver unit 14. The receiver unit 14 also may include a microcontroller (not shown) for controlling the DSP 50 and the transceiver 48. Alternatively, this role could be taken over by the DSP 50.

The receiver unit 14B also receives the RF signals transmitted by the transmission units 10A, 10B, 10C which are demodulated by the transceiver 48 and which are separated into the respective signals M1, M2, M3 as transmitted by each of the transmission unit 10A, 10B, 10C in order to determine the RSSI value in an RF signal analyzer unit 70 which provides as an output the present RSSI value for each of the transmission units 10A, 10B and 10C. The output of the analyzer unit 70 is supplied to the transceiver 48 for being transmitted via the link 12' to the relay unit 15 as the left ear RF signal measurement data $RSSI_L$, which then is used by the angular localization estimation unit 40 of the relay unit 15.

While in FIG. 3 only the left ear receiver unit 14B is shown, it is to be understood that the corresponding right ear receiver unit 14A has an analogous design, wherein the right ear audio signal channel $audio_R$ is received, processed and supplied to the hearing aid 16 or to the speaker 60 and wherein the right ear RF signal measurement data, namely the values of $RSSI_R$, is generated and transmitted to the relay unit 15.

Figure 5:
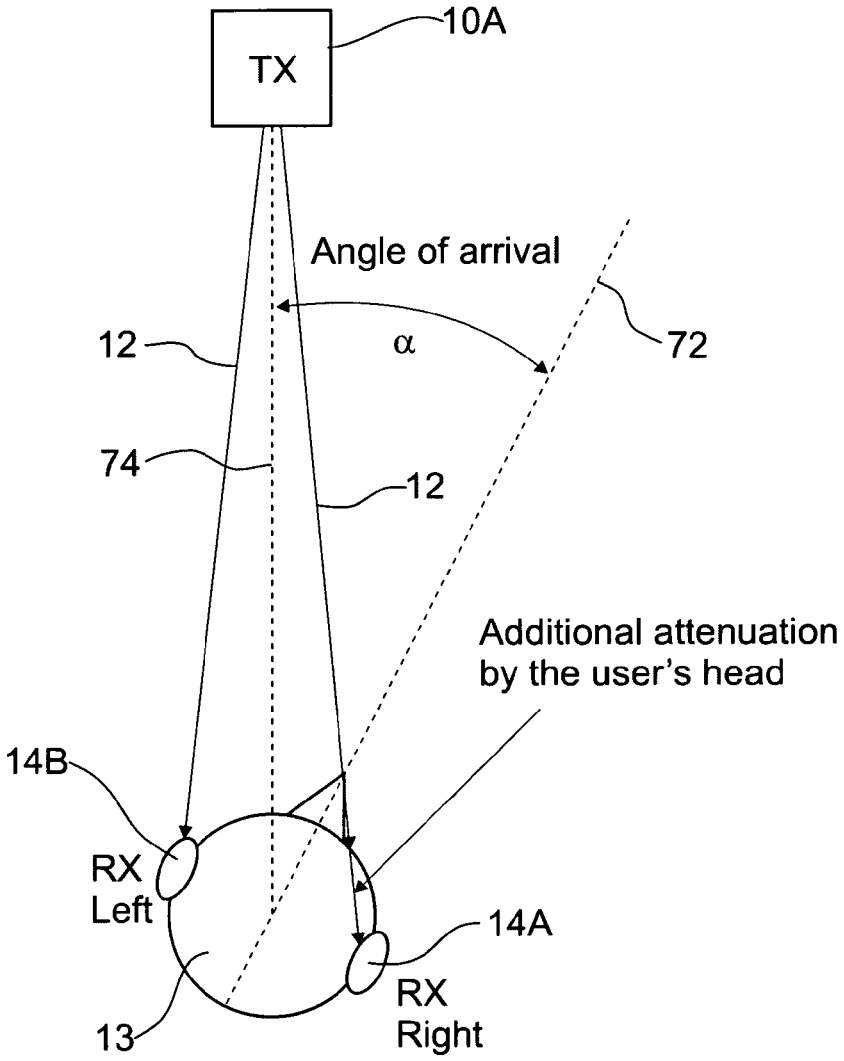
FIG. 5 is an illustration of the attenuation of RF signals by the head of a user of the receiver units of a hearing assistance system according to the invention.

The principle of the angular localization estimation employed by the present invention is illustrated in FIG. 5. The RF signals 12 transmitted by one of the transmission units (in FIG. 5 the transmission unit 10A is shown) are received by the right ear receiver unit 14A and the left ear receiver unit 14B at a level depending on the angle of arrival a in a horizontal plane formed between the looking direction 72 of the user (i.e., a direction in a horizontal plane and perpendicular to the line connecting the two ears of the user 13) and a line 74 connecting the transmission unit 14A to the center of the head of the user 13 (typically, the vertical position of the transmission unit 14A will be close to the vertical position of the user's head, so that the looking direction 72 and the line 74 may be considered as being located in the same horizontal plane). The reason is that once the angle α deviates from zero (i.e., when the user 13 looks into a direction different from the direction 74 of the transmission unit 14A), due to the adsorption of RF signals by the user's head, the RF signals 12 will be received at the right ear receiver unit 14A and at the left ear receiver unit 14B at different levels; in the example of FIG. 5, the RF signal level as received by the right ear receiver unit 14A will be lower than the RF signal level received at the left ear receiver unit 14B. In general, the signal at that side of the user's head which is in the "shadow" with regard to the transmission unit 10A will receive a weaker RF signal.

Hence, by comparing the RF signal strength as received by the right ear receiver unit 14A and the RF signal strength received at the left ear receiver unit 14B, for example by comparing the respective RSSI values, for a given RF signal source, i.e., for one of the transmission units 10, it is possible to estimate the angular localization i.e., the angle of arrival a for each of RF signal source, i.e., for each of the transmission unit 10. Although the correlation between the signal strength and the angle of arrival in practice may be quite complex, it has been found that it will be possible to distinguish at least some coarse angular regions like "left", "center-front" and "right". In general, the reliability of the angle of arrival estimation will be deteriorated by the occurrence of reflected RF signals (such reflexions, for example, may occur at walls, metallic sealings or metallic white boards close to the user's head or in situations where the RF signal source is not in line of sight with regard to the user's head). The angle of arrival estimation will also be deteriorated if both receivers 14A and 14B do not provide the same RSSI reading output to a given reference signal. In practice this problem can be solved by a proper calibration of the RSSI readout during manufacturing of the receivers.

As already mentioned above, the audio signal processing unit 38 of the relay unit 15 will distribute the audio signals resulting from each of the transmission units 10 in such a manner onto the two stereo channels that the audio signals of each transmission unit 10 will create an angular localization impression corresponding to the estimated angular estimation of the transmission unit 10. For example, if the transmission unit 10A is located to the left of the user 13, the transmission unit 10B is located in front of the user 13 and the transmission unit 10C is located to the right of the user 13, the audio signals will be processed in such a manner that the audio signals from the transmission unit 10A are received at the left side, the audio signals from the transmission unit 10B are received in the center and the audio signals from the transmission unit 10C are received at the right side.

The transmission units 10 used in a hearing assistance system according to the invention are not restricted to wireless microphones as described so far. Rather, at least one of the transmission units could be a TV audio signal source. In this case, the user 13 would be enabled to recognize the angular localization of the TV system.

Typically, the carrier frequencies of the RF signals are above 1 GHz. In particular, at frequencies above 1 GHz the attenuation/shadowing by the user's head is relatively strong. Preferably, the digital audio link 12, 12' is established at a carrier-frequency in the 2.4 GHz ISM band. Alternatively, the digital audio link 12, 12' may established at carrier-frequencies in the 868 MHz or 915 MHz bands, or in as an UWB-link in the 6-10 GHz region.

Figure 6:
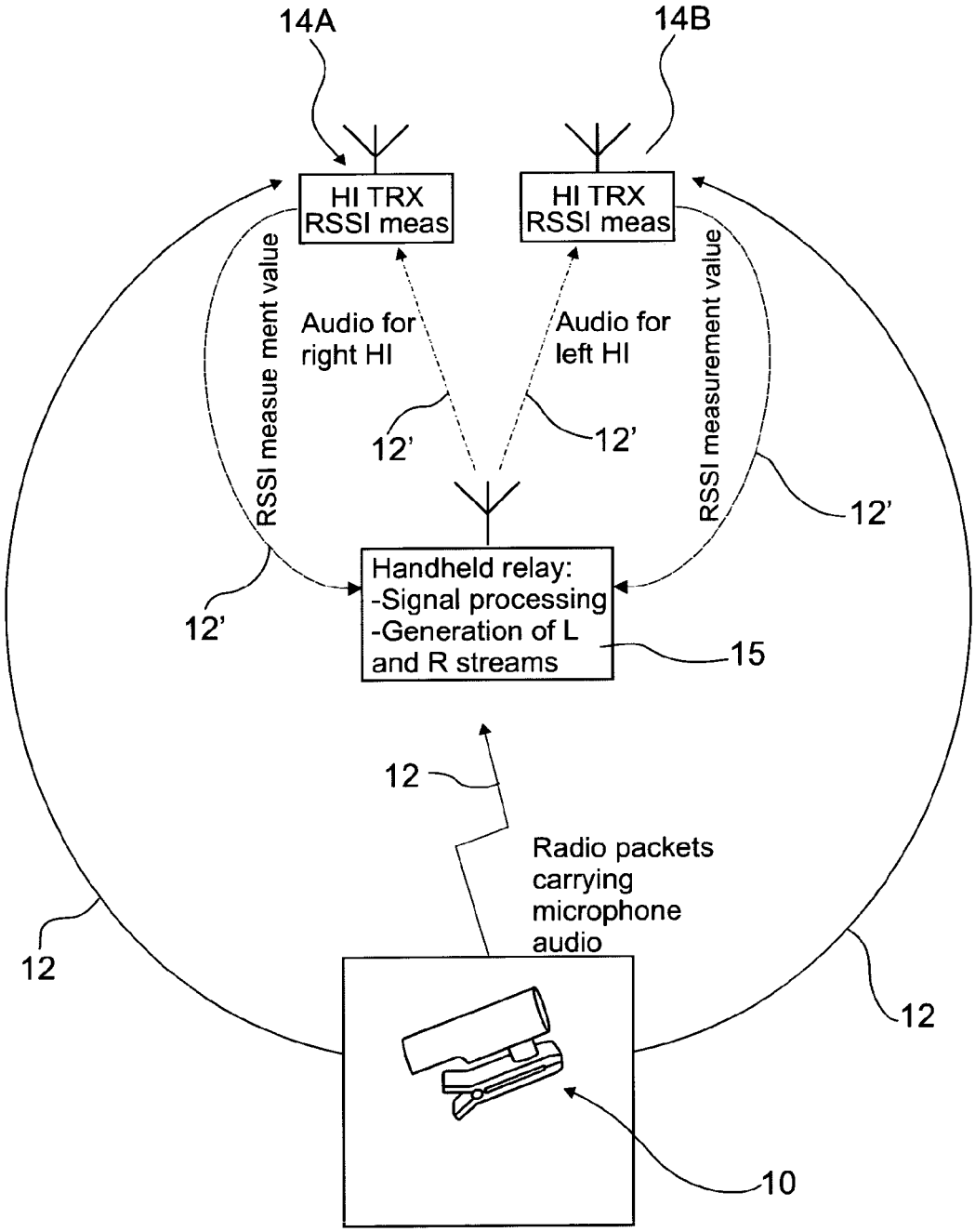
FIG. 6 is a schematic illustration of the wireless signal exchange in a hearing assistance system according to the invention, wherein a relay unit is employed.

The system shown in FIG. 1 may be used by three non-hearing-impaired persons 11A, 11B, 11C equipped with the transmission units 10A, 10B, 10C acting as a wireless microphone and one hearing-impaired person 13 equipped with the hearing aids 16 and the ear-level receiver units 14A, 14B. The relay unit 15 receives the audio streams 19A, 19B, 19C from the microphones 17 of the transmission units 10A, 10B, 10C, combines the audio signals and forwards the combined audio signal as audio stream 21 to the ear level aid receiver units 14A, 14B. The wireless signal exchange in the hearing assistance system of FIG. 1 is also illustrated in FIG. 6.

The digital link 12, 12' preferably uses a TDMA schedule with frequency hopping, wherein each TDMA slot is transmitted at a different frequency selected according to a frequency hopping scheme. In particular, each transmission unit 10 and the relay unit 15 transmit each audio data packet in at least one allocated separate slot of a TDMA frame at a different frequency according to a frequency hopping sequence, wherein certain time slots are allocated to each of the transmission unit 10 and the relay unit 15, and wherein the RF signals from the individual transmission units 10A, 10B, 10C are distinguished by the receiver units 14A, 14B and by the relay unit 15 by the time slots in which they are received.

Usually, the relay unit 15 will act as a master device and the transmission units 10 and the receiver units 14 act as slave devices. To this end, the relay unit 15 sends the necessary control data via the digital link 12, 12' to the slave devices. For example, a beacon packet may be transmitted from the relay unit 15 in the first slot of each TDMA frame which contains information for hopping frequency synchronization and which may also contain information relevant for the audio streams 19A, 19B, 19C, 21, such as description of encoding format, description of audio content, gain parameter, surrounding noise level, information relevant for multi-talker network operation, and/or control data for all or a specific one of the transmission units 10 and/or the receiver unit 14.

Figures 8, 9:
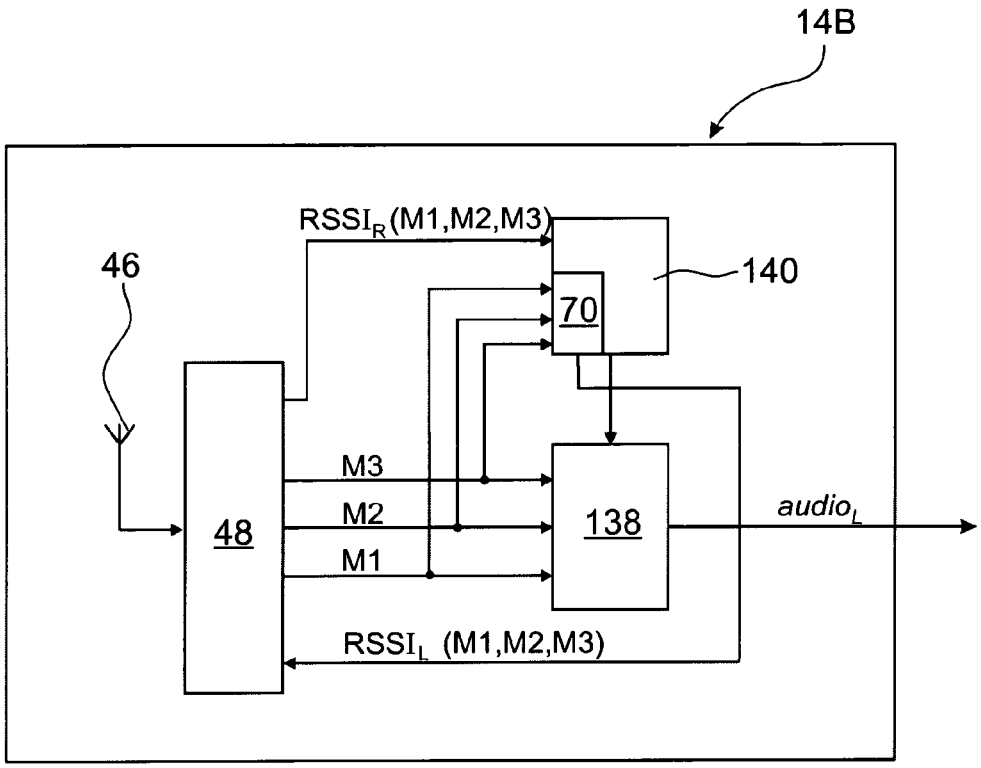
FIG. 8 is an illustration of a schematic example of the audio signal path of a receiver unit of the system of FIG. 7.
FIG. 9 is an example of a TDMA frame structure of the digital audio link used in a system according to the invention, wherein a relay unit is employed.

An example of a TDMA schedule of the link 12, 12' is shown in FIG. 9. Beacons may be transmitted in time slot #0 by the master (i.e., the relay unit 15) to the slaves (transmission units 10 and receiver units 14). Responses to queries transmitted by the master within the beacon may be sent in slot #1 by the slaves. The TDMA slots #2 and 3 may be allocated to audio data packets from the transmission unit 10A, slots #4 and 5 may be allocated to audio data packets from the transmission unit 10B, and slots #6 and 7 may be allocated to audio data packets from the transmission unit 10C. Similarly, certain time slots are allocated to the right ear channel audio data packets and to the left ear channel audio data packets, respectively, wherein the right ear channel audio data packets and the left ear channel audio data packets are distinguished by the time slots in which they are received by the receiver units 14A, 14B. For example, slots #8 and 9 may be allocated to transmission of the right ear channel audio data packets, and slots #10 and 11 may be allocated to transmission of the left ear channel audio data packets.

In addition, certain time slots are allocated to each receiver unit 14A, 14B for transmitting a data packet containing the respective RF signal measurement data, i.e., the RSSI values for each transmission unit 10. For example, slot #12 may be allocated to transmission of the RSSI values of the right ear receiver unit 14A, and slot #13 may be allocated to transmission of the RSSI values of the left ear receiver unit 14B. Alternatively, the RSSI values sent from the receiver units 14A, 14B may be added to the response payload sent in slot #1, thereby saving the slots #12 and 13.

Alternatively, slot #0 may be shared by beacons and responses by time multiplexing, thus saving one slot or leaving room, for example, for an additional slot for the transmission of the mixed audio signal in order to enhance redundancy and robustness of this signal.

Typically, the TDMA schedule is structured for unidirectional broadcast transmission of the audio data packets from the relay unit 15 wherein the same audio packet of the processed stereo audio signal is transmitted preferably at least twice in the same TDMA frame (in the example of FIG. 1 in slots #8 to 11), without expecting acknowledgement messages from the receiver units 14. Preferably, the TDMA schedule is structured also for unidirectional broadcast transmission of the audio data packets from the transmission units 10, without individually addressing the relay unit 15 (or the receiver units 14), wherein preferably the same audio data packet of each of the transmission units 10 is to be transmitted at least twice in the same TDMA frame (in the example of FIG. 1, see e.g., slots #2 and 3 for the transmission unit 10A), without expecting acknowledgement messages from the relay unit 15. Preferably, as shown in the example of FIG. 1, the same audio data packet is to be transmitted at least twice in subsequent slots.

Preferably, the TDMA slots are allocated in such a manner that for each transmission unit 10 the same number of audio data packets per frame is available and that also for the relay unit 15 at least the same number of audio data packet slots per frame is available. Typically, the TDMA schedule is kept constant, i.e., the allocation of the slots to the audio data packets is the same for each frame.

Allocation of the slots is done by the relay unit 15 by transmitting respective beacon packets. In case that more transmission units 10 are used than can be handled simultaneously by the TDMA schedule (in the example of FIG. 1 only three transmission units 10 can be handled), audio channels, i.e., TDMA slots, may be allocated to the transmission units on a dynamic basis via signaling through the beacon and response slots. Allocation of channels is transmitted in the beacon, while resource requests from the transmission units 10 are transmitted in the response slot to the relay unit. In this manner, for example, an audio channel may be allocated to that one of the transmission units 10 which has found, via the VAD 24, that its speaker 11 is presently speaking.

Figure 10:
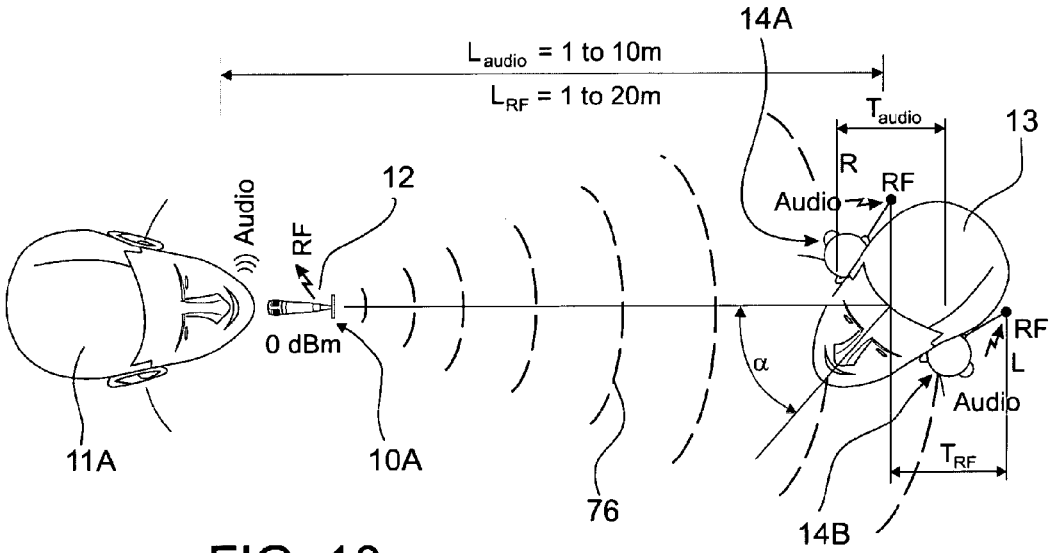
FIG. 10 is an illustration of how the arrival times of direct sound and of RF signals at the head of a user of a receiver unit of a hearing assistance system according to the invention can be used for estimating the angle of arrival of the RF signals.

According to an alternative embodiment, the angular localization of transmission units 10 may be estimated by measuring the arrival times of the RF signals and the sound generated by the speaker's voice using the respective transmission unit 10 with regard to the right ear receiver unit 14A and the left ear receiver unit 14B, rather than determining the RF signal level difference as described above. This principle is illustrated in FIG. 10. In this embodiment it is necessary that the audio signal from a transmission unit 10 is received both via the RF link 12 and via the air as sound waves 76. Reception of the audio signals via the RF link 12 occurs similarly to the previously described embodiments. In addition, the voice of the speaker 11 using the transmission unit 10 is also received as sound by the hearing aid microphone 62 which generates corresponding audio signals which are correlated with the received RF signal in order to determine the arrival time difference of a sound event in the RF signal and in the audio signals captured by the hearing aid microphone 62. Such correlation is determined in each of the receiver units 14A, 14B. The result of such correlation calculation is the time shift between the RF signal and the audio signal for each ear. This time shift then is transmitted, as a right ear RF signal measurement data and a left ear RF signal measurement data, respectively, to the relay unit 15, where the difference between the measurements taken at the left ear and at the right ear is calculated, with this difference corresponding to the delay $T_{audio}$ of the sound waves due to the additional sound path length caused by an angle of arrival a deviating from zero. By taking into account the speed of sound in air, the angle of arrival a of the audio/RF signals can be determined based on this delay time.

While the invention has been described so far with reference to a hearing assistance system employing a relay unit, the invention is also applicable to systems not using such relay unit.

Figure 7:
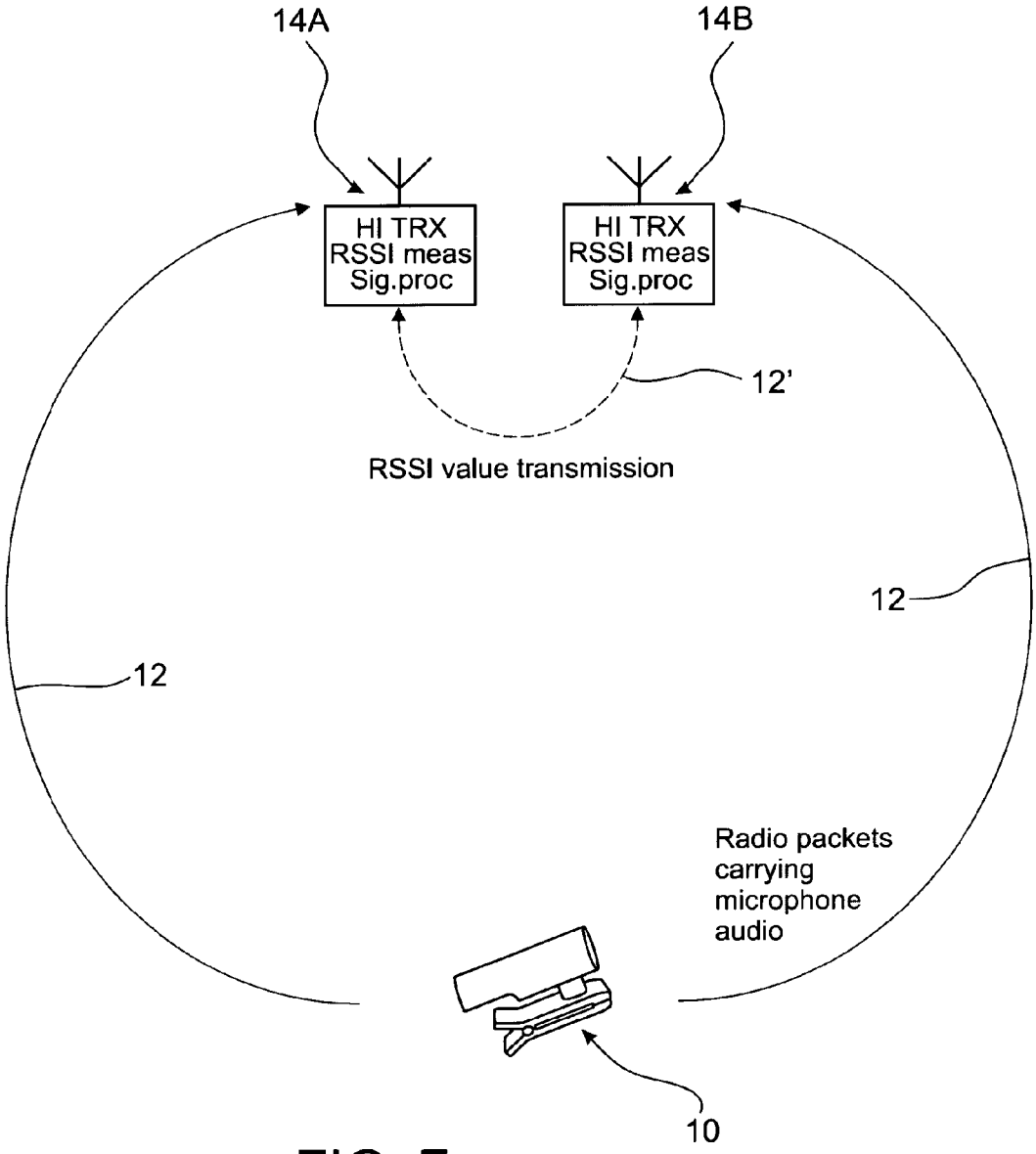
FIG. 7 is a schematic illustration of the wireless signal exchange in a hearing assistance system according to the invention, wherein no relay unit is employed.

An example of such an embodiment is shown in FIGS. 7 and 8, with FIG. 7 showing an illustration of the hearing assistance system comprising at least one of the transmission units 10, a right ear receiver unit 14A and a left ear receiver unit 14B, and with FIG. 8 showing an example of the audio signal path in the left ear receiver unit 14B.

In the example of FIG. 8, the transceiver 48 receives the audio signals transmitted from the transmission unit 10 via the digital link 12, i.e., it receives and demodulates the audio signal streams 19A, 19B, 19C transmitted from the transmission units 10A, 10B, 10C into respective output signals M1, M2, M3 which are supplied as separate signals, i.e., as three audio streams, to an audio signal processing unit 138. In addition, the audio streams M1, M2, M3 are also supplied to a signal strength analyzer unit 70 which determines the RSSI value of the RF signals from each of the transmission units 10A, 10B, 10C separately, wherein the output of the unit 70 is supplied to the transceiver 48 for being transmitted via the antenna 46 to the other receiver unit, i.e., to the right ear receiver unit 14A (in FIG. 8, the output of the RF signal strength analyzer unit 70 is indicated by "$RSSI_L$").

The output of the unit 70 is also supplied to an angular localization estimation unit 140. The transceiver 48 receives the right ear RF signal measurement data, i.e., the RF signal level $RSSI_R$ of each of the transmission units 10A, 10B, 10C, from the other receiver unit, i.e., the right ear receiver unit 14A, and the respective demodulated signal is supplied to the angular localization estimation unit 140. Hence, similarly to the angular localization estimation unit 140 of the relay unit 15 of the embodiment of FIG. 4, the angular localization estimation unit 140 is provided with the left ear RF signal measurement data and the right ear RF signal measurement data, i.e., with the RSSI values $RSSI_R$ and $RSSI_L$, in order to estimate the angular localization of each transmission unit 10A, 10B, 10C by comparing the respective right ear RF signal level and the left ear RF signal level. The angular localization estimation unit 140 then controls audio signal processing in the audio signal processing unit 138 in such a manner that for each of the transmission units 10A, 10B, 10C the respective left ear channel $audio_L$ of a stereo audio signal is generated from the audio streams M1, M2 and M3 of the transmission unit 10A, 10B, 10C. The complementary right ear channel of such stereo audio signal is generated simultaneously by the right receiver unit 14A in an analogous manner. As is the case of the embodiments employing a relay unit, the stereo signal is generated in such a manner that it creates an angular localization impression of the audio signals from each transmission unit 10A, 10B, 10C as received by the user which corresponds to the estimated angular localization of the respective transmission unit 10A, 10B, 10C.

Hence, in the embodiment shown in FIGS. 7 and 8, the angular localization estimation and the audio signal processing, which functions, in the example of FIGS. 1 to 6, are performed in the relay unit 15, are distributed onto the receiver units 14A, 14B, with each receiver unit 14A, 14B generating one of the two stereo audio channels.

It is to be understood that as in the receiver example shown in FIG. 3, the transmission units 10 may transmit control data to the receiver units 14A, 14B which are used by the audio signal processing unit 138.

It is to be mentioned that, as a alternative to the above-described methods for estimating the angular localization of the RF transmission units, in principle one could measure the RF signal time of arrival at each of the receiver units 14A, 14B and estimate the angular of arrival from the time delay obtained by comparing the time of arrival at the right ear receiver unit 14A and the left ear receiver unit 14B. However, in this case it would be necessary to provide for a precise common time base for measuring the time of flight of the RF signals. Such precise common time base requires a complex mechanism of query/answer signals exchange between the two receiver units 14A, 14B and a very precise clock in each receiver unit 14A, 14B, which, in turn, may result in relatively high power consumption and size. Alternatively, the common time base could be transmitted from another device which has to be placed at the same distance to the right ear receiver unit 14A and the left ear receiver unit 14B, which arrangement may be cumbersome in practice.

As a further alternative, one may measure the phase difference between the RF signals at the two receiver units 14A, 14B at the same frequency by using a mixer. However, in practice this may be difficult, since it requires a phase reference for both receiver units 14A, 14B.

In general, the present invention requires that at least one parameter of the RF signal (such as amplitude, phase, delay, i.e., arrival time, and correlation with the acoustic signal) is measured both at the right ear receiver unit 14A and at the left ear receiver unit 14B, in order to create right ear RF signal measurement data and left ear RF signal measurement data, which then are compared for estimating the angular localization of the transmission unit.

It is pointed out that the present invention does not require that the hearing assistance system includes a plurality of transmission units. Rather, it may include only a single transmission unit.

In the hearing assistance systems according to the invention, distances between the transmission unit(s) and the receiver units typically are from 1 to 20 m.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

The invention claimed is:

1. A system for providing hearing assistance to a user, comprising:

at least one audio signal transmission unit comprising an audio signal source and means for transmitting audio signals from the audio signal source via a wireless radio frequency (RF) link;

a left ear receiver unit to be worn at or at least partially in a user's left ear and a right ear receiver unit to be worn at or at least partially in a user's right ear, wherein each receiver unit is connected to or comprises means for stimulating a user's hearing and comprises means for receiving an RF signal from the at least one transmission unit via the wireless RF link, and means for measuring at least one parameter of the RF signal as received from the at least one transmission unit at the respective receiver unit in order to create left ear RF signal measurement data and right ear RF signal measurement data, respectively;

means for estimating an angular localization of each transmission unit by comparing, for each transmission unit, the left ear RF signal measurement data and the right ear RF signal measurement data, with each receiver unit comprising means for supplying said RF signal measurement data to said angular localization estimating means; and means for processing the audio signals received from the at least one transmission unit via the wireless RF link by distributing the audio signals onto a left ear channel to be supplied via the left ear receiver unit to the left ear stimulating means and a right ear channel to be supplied via the right ear receiver unit to the right ear stimulating means according to the estimated angular localization of each transmission unit in a manner so that an angular localization impression of the audio signals from each transmission unit as perceived by the user corresponds to the estimated angular localization of the respective transmission unit.

2. The system of claim 1, wherein the audio signal processing means is adapted to distribute the received audio signals of each transmission unit onto the left ear channel and the right ear channel by introducing a relative phase delay between the left ear channel signal part and the right ear channel signal part of the audio signals from respective transmission unit according to the estimated angular localization of the respective transmission unit.

3. The system of claim 1, wherein the audio signal processing means is adapted to distribute the received audio signals of each transmission unit onto the left ear channel and the right ear channel by introducing a relative level difference between the left ear channel signal part and the right ear channel signal part of the audio signals from respective transmission unit according to the estimated angular localization of the respective transmission unit.

4. The system of claim 1, wherein the angular localization estimating means and the audio signal processing means form part of a relay unit comprising means for receiving audio signals from the transmission unit(s) via the wireless RF link and means for transmitting the left ear channel to the left ear receiver unit and for transmitting the right ear channel to the right ear receiver unit.

5. The system of claim 4, wherein the means for transmitting the left ear channel to the left ear receiver unit and for transmitting the right ear channel to the right ear receiver unit are adapted to transmit the left ear channel and the right ear channel via a wireless audio link.

6. The system of claim 5, wherein the wireless audio link forms part of said RF link.

7. The system of claim 1, wherein the angular localization estimating means and the audio signal processing means form part of the receiver units, wherein the left ear channel is processed in the left ear receiver unit and the right ear channel is processed in the right ear receiver unit, and wherein the receiver units comprise means for exchanging RF signal measurement data as said means for supplying said RF signal measurement data to said angular localization estimating means.

8. The system of claim 1, wherein each audio signal source comprises a microphone arrangement.

9. The system of claim 8, wherein each transmission unit is to be worn by a person in manner so as to capture the person's voice by the respective microphone arrangement.

10. The system of claim 1, wherein the audio signal source is a TV-audio signal.

11. The system of claim 4, wherein each transmission unit and the relay unit are adapted to transmit each audio data packet in at least one allocated separate slot of a TDMA frame at a different frequency according to a frequency hopping sequence, wherein certain time slots are allocated to each of the transmission units, and to the relay unit, if present, and wherein the RF signals from the individual transmission units are distinguished by the receiver units, and by the relay unit, if present, by the time slots in which they are received.

12. The system of claim 11, wherein certain time slots are allocated to each receiver unit for transmitting a data packet containing the respective RF signal measurement data.

13. The system of claim 4, wherein certain time slots are allocated to the right ear channel audio data packets and to the left ear channel audio data packets, respectively, and wherein the right ear channel audio data packets and to the left ear channel audio data packets are distinguished by the time slots in which they are received by the receiver units.

14. The system of claim 1, wherein the at least one RF signal measurement parameter comprises a level of the RF signal received by the respective receiver unit, and wherein said measuring means of each receiver unit is for determining a level of the RF signal received by the respective receiver unit.

15. The system of claim 14, wherein said measuring means is for providing the determined RF signal level as an RSSI signal.

16. The system of claim 9, wherein each receiver unit is mechanically and electrically connected to a hearing aid comprising the stimulation means or is integrated within a hearing aid, wherein the RF signal measuring means is adapted to determine, for each ear, by correlating the received RF signal and an audio signal as captured by the hearing aid microphone, an arrival time difference of a sound event in the RF signal and in the audio signal, and wherein the angular localization estimating means are adapted to estimate the angular localization of each transmission unit by determining a difference between the right ear sound event arrival time difference and the left ear sound event arrival time difference.

17. The system of claim 1, wherein each receiver unit is mechanically and electrically connected to a hearing aid comprising the stimulation means.

18. The system of claim 1, wherein each receiver unit is integrated within a hearing aid.

19. The system of claim 1, wherein carrier frequencies of the RF link are above 1 GHz.

20. The system of claim 1, wherein each transmission unit is adapted to transmit each audio data packet in at least one allocated separate slot of a TDMA frame at a different frequency according to a frequency hopping sequence, wherein certain time slots are allocated to each of the transmission units, and to the relay unit, if present, and wherein the RF signals from the individual transmission units are distinguished by the receiver units, and by the relay unit, if present, by the time slots in which they are received.

21. A method of providing hearing assistance to a user, comprising the steps of:

providing audio signals at at least one audio signal transmission unit and transmitting audio signals from the at least audio signal transmission unit via a wireless RF link;

receiving the RF signal of the wireless RF link at a left ear receiver unit worn at or at least partially in a user's left ear and at a right ear receiver unit worn at or at least partially in a user's right ear;

measuring at least one parameter of the RF signal as received from the transmission unit(s) at the respective receiver unit in order to create left ear RF signal measurement data and right ear RF signal measurement data, respectively;

estimating a angular localization of each transmission unit by comparing the left ear RF signal measurement data and right ear RF signal measurement data, processing the audio signals received via the wireless RF link by distributing the audio signals onto a left ear channel to be supplied by the left ear receiver unit to the left ear stimulating means and a right ear channel to be supplied by the right ear receiver unit to the right ear stimulating means according to the estimated angular localization of each transmission unit; and stimulating the user's left ear according to the left ear channel and stimulating the user's right ear according to the right ear channel;

wherein the audio signals are distributed onto the left ear channel and the right ear channel in a manner so that an angular localization impression of the audio signals from each transmission unit as perceived by the user corresponds to the angular localization of the respective transmission unit as estimated by the RF signal measurements.

* * * * *